United States Patent [19]

Aquarian

[11] 4,153,170

[45] May 8, 1979

[54] APPARATUS FOR WEANING CHILDREN

[76] Inventor: Star T. Aquarian, 122 Serra St., #A, San Clemente, Calif. 92672

[21] Appl. No.: 793,072

[22] Filed: May 2, 1977

[51] Int. Cl.[2] ..... A61J 9/00

[52] U.S. Cl. ..... 215/11 R; 215/1 A

[58] Field of Search ..... 215/11 R, 1 A; 229/7 S

[56] References Cited

U.S. PATENT DOCUMENTS

| | | | |
|---|---|---|---|
| 468,759 | 2/1892 | Bobrick | 215/11 R |
| 514,974 | 2/1894 | Turck | 215/11 R |
| 593,830 | 11/1897 | Borgenschild | 215/11 R |
| 2,655,279 | 10/1953 | Wolf | 215/11 R |
| 3,076,574 | 2/1963 | Woodbury | 215/11 R |
| 3,253,753 | 5/1966 | Barton | 215/11 R |
| 3,346,133 | 10/1967 | Herdman | 215/11 R |
| 3,661,288 | 5/1972 | Noll | 215/1 A |
| 3,773,256 | 11/1973 | Wright | 215/1 A |

*Primary Examiner*—Ro E. Hart

*Attorney, Agent, or Firm*—I. Michael Bak-Boychuk

[57] ABSTRACT

A weaning device comprising a rubber nipple having the opening thereof conformed for receipt of a drinking straw, the other end of the straw being insertable into a liquid container. In this form as an infant becomes adept in ingesting larger volumes of liquid through a nipple the foregoing device may be substituted therefor comprising one step of a weaning process whereby the child is taught to ingest liquids through a straw.

1 Claim, 5 Drawing Figures

FIG. 1
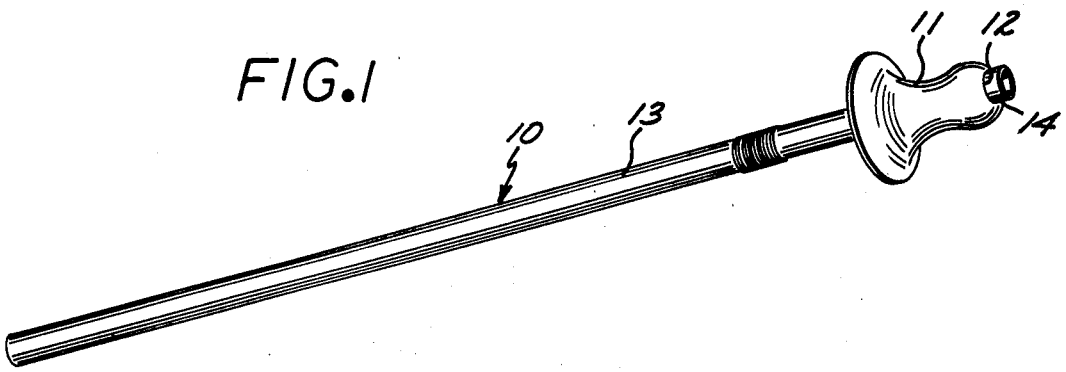
FIG. 4
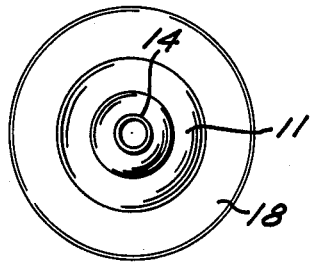
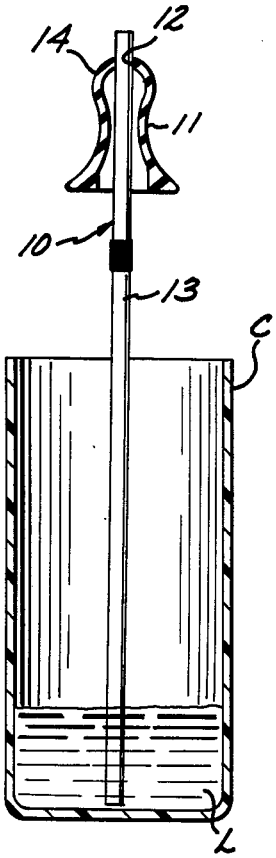
FIG. 2
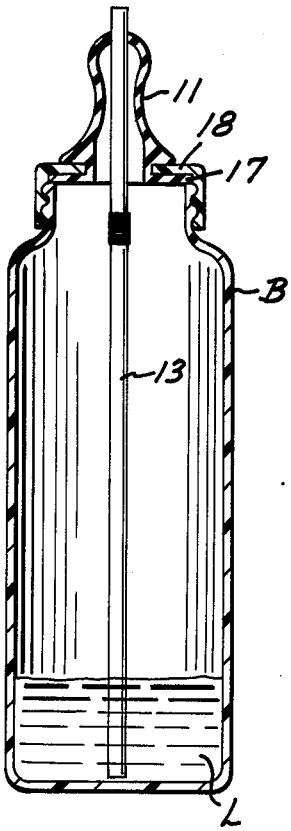
FIG. 3
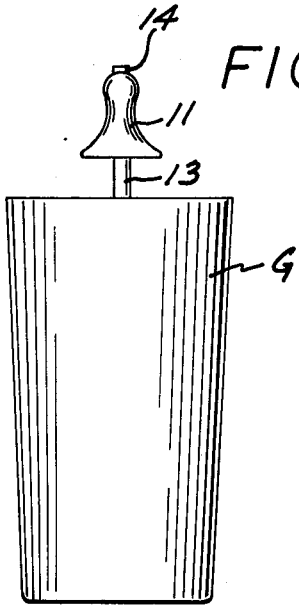
FIG. 5

APPARATUS FOR WEANING CHILDREN

BACKGROUND OF THE INVENTION

1. Field of the Invention

The present invention relates to method and apparatus for weaning children, and more particularly to the use of a drinking straw in combination with a nipple in the course of the weaning.

2. Description of the Prior Art

Bottle feeding of infants has been practiced extensively in the past to a point where the child acquires strong habits in the manner that it ingests liquids. As result of these habits the mother is continually encumbered with the task of maintaining sanitary bottles and nipples, a task at the very least cumbersome, particularly during travel. Furthermore, as result of these relatively strong oral habits, the course of weaning the child into a more ordinary method of taking liquids is rendered rather difficult and children of relatively mature age are frequently found to prefer the bottle feeding technique. In the past, most efforts in improving the bottle feeding techniques were efforts directed at removing or limiting the intake of air during feeding and very little attention has been directed to the weaning process itself. Thus, while there are devices developed in the past wherein a straw-like structure is attached to the nipple, most often such devices do not include the straw in the actual orifice of the nipple, in each instance elaborate structure being provided for adapting the straw-like structure to the nipple opening. For this reason these prior art devices did not address or contemplate the training of new habits, in each instance the flow rate produced thereby being substantially lower than the flow rate achievable through a straw in its raw form. Furthermore, these same elaborate interconnections between the straw-like fixture and the nipple itself avoided the necessary end production of the straw through the nipple through which the oral muscles of the child would become familiar with the straw end.

SUMMARY OF THE INVENTION

Accordingly, it is the general purpose and object of the present invention to provide a weaning device comprising a nipple having one end of the straw exposed through the opening thereon.

Other objects of the invention are to provide a weaning device useful in the course of training an infant to adapt to the use of the straw.

Yet further objects of the invention are to provide a weaning device which is easy to produce, convenient in use, and which is furthermore adapted to receive any conventionally available drinking straw.

Briefly these and other objects are accomplished within the present invention by combining a nipple with a straw, the orifice in the nipple being increased to a diameter just smaller than the exterior diameter of the straw. In this configuration, the nipple is stretched to receive the straw, one end of the straw thus partly extending through the orifice. The nipple may then be used in this modified form as a drinking utensil, together with any conventional drinking container, or the same nipple may be mounted on a bottle in the conventional manner to deploy the straw towards the bottom thereof. In use it is contemplated to first introduce the infant to the last example set out, i.e. it is contemplated to modify the nipple in the above manner and install that same nipple onto the feeding bottle. Thus, the infant is familiarized with the new oral sensation of the straw end protruding through the nipple and furthermore is trained to accept the relatively higher flow rate achievable through the straw. In this form however, the vacuum produced during suction within the bottle can be controlled in the conventional manner by tightening the bottle cap retaining the nipple, thus providing a convenient technique by which lower flow rates can be first set in until the child becomes more adept. Once the child is fully adept with the bottle configuration it can then be introduced to an unretained nipple/straw configuration. In this form the child still experiences the form of the nipple within its oral muscles and therefore does not have to be retrained for the reception of a naked straw.

The course of introduction set out above also trains the infant to align the bottle properly in order to obtain the liquid, thus training the child towards the correct use of the straw. After such training is mastered the child can then conveniently accompany the parents on any trip, being fully capable of utilizing conveniently available straws in any commercial food outlet.

BRIEF DESCRIPTION OF THE DRAWING

FIG. 1 is a perspective illustration of a weaning device constructed according to the present invention;

FIG. 2 is a side view in section illustrating the inventive weaning device in its final form;

FIG. 3 is yet another side view in section illustrating a weaning device conformed for use with a feeding bottle, this form being adapted to provide the first introduction of an infant to the inventive structure set forth herein;

FIG. 4 is a top view of the structure shown in FIG. 3; and

FIG. 5 is a side view illustrating the weaning device set forth herein used in conjunction with any conventional drinking container.

DESCRIPTION OF THE PREFERRED EMBODIMENT

As shown in FIGS. 1 and 2, a weaning device generally designated by the numeral 10 comprises a nipple 11 of the flexible kind, such as those frequently used in baby feeding, nipple 11 being provided with an end orifice 12 conformed to a radial dimension just smaller than the sectional dimension of a straw 13. In this form the nipple 11 is stretched over the straw 13 exposing one end of the straw shown herein as an end segment 14 beyond the end surface of the nipple. An infant previously trained to receive a nipple is now exposed to the straw end, and by virtue of this exposure quickly learns the receipt of fluids therethrough.

The weaning device 10 is adapted for insertion into a liquid container C such as a cup, the lower end of straw 13 being immersed in the liquid L contained therein. In this form, the infant must already possess the necessary manipulative skill in order to both align the straw within the liquid L and to maintain the cup C substantially vertical. This manipulative skill is first achieved by way of yet another configuration, shown in detail in FIG. 3. More specifically, in this figure, the nipple 11 is provided with the conventional lower flange 17 which is secured by way of an annular cap 18 to the top of a feeding bottle B. Once more the straw 13 extending through the nipple 11 is immersed at the lower end thereof into the body of liquid L. The infant thus is able to achieve the necessary skills in order to maintain the straw in this position, the retention of the bottle providing the necessary safety factor against inadvertent spillage. As shown in FIG. 4 the disposition of the straw is substantially central to the bottle B and the child as yet is not fully familiar with the independent manipulation thereof. The flexibility of nipple 11 however, does allow the infant some degree of control over the disposition of the straw within the liquid L and it is through this degree of freedom that certain additional manipulative skills are achieved. Thus the child, before exposure to the device in the form shown in FIG. 2, will achieve a certain familiarity with the feeding technique by way of the configurations shown in FIG. 3.

While the foregoing description entails several successive configurations, i.e. such as those shown in FIGS. 2 and 3, it is to be noted that the same nipple configuration as that shown in FIG. 3 may be utilized in the use set out in FIG. 2. It is only for purposes of clarity and simplicity that the nipple 11 in FIG. 2 is shown without a flange, the intent therein being to simplify the structure which is particularly suited for infants already trained. As shown in FIG. 5 this same structure can be used with any container such as a glass G, it being necessary only to transport the nipple itself, the straw 13 being available at any commercial fast-food outlet.

Some of the many advantages of the present invention should now be readily apparent. The invention provides by way of minor modifications in what has been previously a conventional device both a method and a structure through which an infant may be trained to utilize a straw in the course of feeding. Once adapted to this manner of feeding this same infant can then be fed by devices conventionally available in commercial food servicing outlets.

Obviously many modifications and variations to the above disclosure can be made without departing from the spirit of the invention. It is therefore intended that the scope of the invention be determined solely dependent on the claims hereto.

What is claimed is:

1. In a baby bottle assembly including a bottle, a flexible nipple conformed to engage the opening in said bottle and means for securing said nipple to said bottle, the improvement comprising:

a drinking straw receivable in said bottle extending partly through said nipple to project beyond the end of said nipple in a projection dimensioned for receipt in the mouth of an infant when the infant grasps said nipple with its lips, said nipple being provided with an orifice of a sectional dimension just smaller than said straw, whereby said nipple is stretched about said straw for retention thereof in said bottle.

* * * * *